US007414498B2

(12) United States Patent
McCoy

(10) Patent No.: US 7,414,498 B2
(45) Date of Patent: Aug. 19, 2008

(54) ENHANCED SOLENOID-ARMATURE INTERFACE

(75) Inventor: Brian Timothy McCoy, Duluth, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 145 days.

(21) Appl. No.: 11/190,368

(22) Filed: Jul. 27, 2005

(65) Prior Publication Data

US 2006/0097829 A1 May 11, 2006

Related U.S. Application Data

(60) Provisional application No. 60/591,543, filed on Jul. 27, 2004.

(51) Int. Cl.
*H01H 73/00* (2006.01)

(52) U.S. Cl. ..... 335/6; 335/21; 335/23; 335/172; 335/175

(58) Field of Classification Search ..... 335/17, 335/21–23, 172–176, 6–10, 35, 36; 361/42
See application file for complete search history.

(56) References Cited

U.S. PATENT DOCUMENTS 4,382,270 A 5/1983 Davidson et al. ..... 361/115
4,667,263 A 5/1987 Morris et al. ..... 361/42
5,223,681 A * 6/1993 Buehler et al. ..... 218/22
5,260,676 A 11/1993 Patel
5,444,424 A 8/1995 Wong et al. ..... 335/172
5,483,211 A 1/1996 Carrodus et al. ..... 335/18
5,546,266 A 8/1996 MacKenzie
5,847,913 A 12/1998 Turner
6,049,143 A 4/2000 Simpson
6,366,187 B1 4/2002 Malingowski
6,552,884 B2 4/2003 Kim
6,717,782 B2 4/2004 DiSalvo
6,853,279 B1 2/2005 Puskar

OTHER PUBLICATIONS

International Search report, Application No. PCT/US2005/026613 mailed on Oct. 26, 2005.

* cited by examiner

*Primary Examiner*—Ramon M Barrera

(57) ABSTRACT

Certain exemplary embodiments include a circuit breaker armature that includes and/or defines a contact zone intersected by a longitudinal axis of a solenoid comprising a plunger, the solenoid adapted to extend the plunger along the longitudinal axis to engage with the contact zone and move the armature, a predefined movement of the armature adapted to cause a trip of the circuit breaker.

20 Claims, 5 Drawing Sheets

ENHANCED SOLENOID-ARMATURE INTERFACE

CROSS-REFERENCES TO RELATED APPLICATIONS

This application claims priority to, and incorporates by reference herein in its entirety, pending U.S. Provisional Patent Application Ser. No. 60/591,543, filed 27 Jul. 2004, and U.S. patent application Ser. No. 11/070,073, filed Mar. 2, 2005.

BACKGROUND

U.S. Pat. No. 6,853,279 (Puskar), which is incorporated by reference herein in its entirety, allegedly recites a "trip unit includes a housing, a rotary plunger mounted in the housing and a pivotal trip bar also mounted therein. The trip bar latches the plunger in an on position, releases the plunger to a tripped position and re-latches the plunger. A set of springs biases the plunger to the tripped position. A rotary trip lever is pivotally mounted in the housing. A trip solenoid includes a linear plunger, which resets the solenoid when retracted, and which engages and rotates the trip lever when extended, in order to rotate the trip bar and release the rotary plunger. The rotary plunger engages the rotary trip lever when reset and rotates the same in an opposite direction, in order to retract the linear plunger and reset the solenoid. During that reset operation, the rotary plunger also cams the trip bar, in order to re-latch the rotary plunger in the on position." See Abstract.

U.S. Pat. No. 6,552,884 (Kim), which is incorporated by reference herein in its entirety, allegedly recites a "circuit breaker which displays electronically state of the circuit breaker and the cause of the disconnection which enables users to determine whether to reconnect a conductor which connects a source and a load in power distribution system. An arc display part is coupled to an arc fault detector, a ground display part is coupled to a ground fault detector and an overload display part is coupled to an overload detector. If arc fault occurs, the arc fault detector generates a trip signal and the trip signal is provided to the arc display part. As the trip signal from the arc fault detector is not provided to the ground display part and the overload display part, users can determine that arc fault has occurred by the lighting of the arc display part." See Abstract.

U.S. Pat. No. 5,847,913 (Turner), which is incorporated by reference herein in its entirety, allegedly recites a "trip indicator for a circuit breaker in an electrical distribution system. The trip indicator provides a visual indication of the activation of a trip signal caused by arcing fault detector (AFD) or ground fault interrupter (GFI) circuitry. The trip indicator comprises one or more light sources, one or more plungers having a colored tip or one or more bimetal disk having a colored top. In response to activation of a trip signal by the AFD or GFI circuitry, the light source(s) illuminate, the plunger(s) move from a retracted position to an extended position and the bimetal disk(s) move from a generally flat position to a convex position. A conduit is provided within the housing of the protective device for conveying light or the reflection of light between the light source(s), plunger(s) or bimetal disk(s) and an opening of the housing. Where the circuit breaker includes both GFI and AFD circuitry, each generating a respective trip signal in response to the detection of a ground fault or arcing fault, the trip indicator is designed to indicate which of the respective fault conditions activated the trip signal." See Abstract.

U.S. Pat. No. 5,546,266 (Mackenzie), which is incorporated by reference herein in its entirety, allegedly recites that "[i]n a circuit interrupter which has multiple electronic trip circuits, such as ground fault and arcing fault trip circuits, indicators such as LED's produce an indication of the cause of the trip. The trip signals are latched to provide a continuing trip indication and ORed to actuate the trip device. In one embodiment SCR's connected in series with the indicator LED's serve as the latches and are connected in parallel to the trip device to provide the OR function. In other embodiments, flip-flops serve as the latches. In one such embodiment, the indicator LED's are connected from the respective flip-flops in parallel to the trip device to provide the OR function. In another such embodiment the flip-flops actuate the trip device and turn on switches actuating the LED's. These switches energizing the cause of trip LED's are disabled until the contacts open to assure operation of the trip device. Alarms can be coupled to the trip circuit by additional LED's, preferably IR LED's, connected in series with the indicator LED's." See Abstract.

SUMMARY

Certain exemplary embodiments comprises a circuit breaker armature that comprises a contact zone intersected by a longitudinal axis of a solenoid comprising a plunger, the solenoid adapted to extend the plunger along the longitudinal axis to engage with the contact zone and move the armature, a predefined movement of the armature adapted to cause a trip of the circuit breaker.

BRIEF DESCRIPTION OF THE DRAWINGS

A wide variety of potential embodiments will be more readily understood through the following detailed description of certain exemplary embodiments, with reference to the accompanying exemplary drawings in which.

DEFINITIONS

Figure 1:
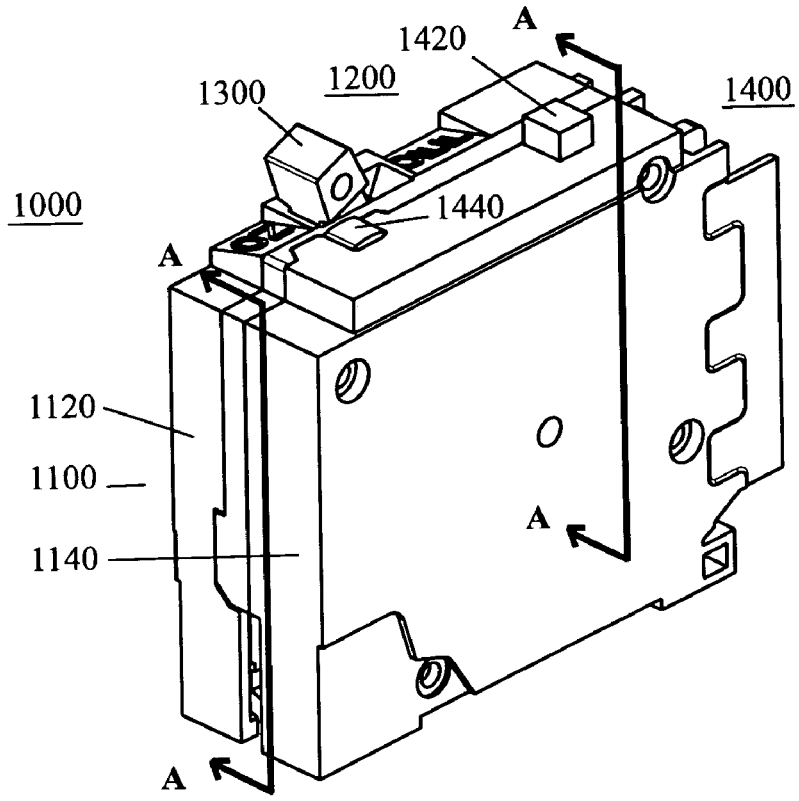
FIG. 1 is a perspective view of an exemplary embodiment of a circuit breaker 1000 in an ON position.

When the following terms are used substantively herein, the accompanying definitions apply:

a—at least one.

actuate—to activate and/or put into motion or action.

adapted to—made suitable or fit for a specific use or situation.

adjacent—next to and/or adjoining.

against—so as to come into forcible contact with.

alternating current—an electric current that reverses direction in a circuit at regular intervals.

apparatus—an appliance or device for a particular purpose arc fault—a discharge of electricity between two or more conductors, the discharge associated with at least a predetermined voltage, current, and/or power level.

armature—a part of an electromagnetic device that moves.

armature latch—a moveable component of a circuit breaker that releasably fastens and/or holds the operating mechanism of the circuit breaker.

arrange—to dispose in a particular order.

axial—located on, around, or in the direction of an axis.

axis—a center line to which parts of a structure or body may be referred.

between—in or through the position or interval separating; intermediate to.

biased—urged in a direction.

bimetal element—a component adapted to be located in the conducting path of the circuit breaker, and adapted to, in response to the flow therethrough of a current of a predetermined approximate amplitude for a predetermined approximate time, generate heat, deflect in response to the heat, and thereby cause the circuit breaker to trip.

can—is capable of, in at least some embodiments.

central—situated at, in, or near the center of a length.

characterizable—describable.

circuit breaker—a re-settable device adapted to automatically open an alternating current electrical circuit to protect the circuit from damage caused by overload and/or short circuit.

comprised by—included by.

comprising—including but not limited to.

conductor—a component of a circuit breaker adapted to conduct a large majority of electrical current carried by the circuit breaker.

connect—to physically link, join, or fasten together.

contact arm—a member comprising one of a pair of electrical contacts engageable to close a circuit.

contact zone—an area or region adapted to be touched and/or impacted by a plunger and/or plunger tip.

couple—to join, connect, and/or link together.

coupleable—capable of being joined, connected, and/or linked together.

current overload—a flow of current above a predetermined value.

cylinder—a solid bounded by two parallel planes and a surface generated by a straight line intersecting and moving along a closed plane curve, the directrix, while remaining parallel to a fixed straight line that is not on or parallel to the plane of the directrix.

cylindrical—of, relating to, or having the shape of a cylinder, especially of a circular cylinder.

define—to establish the outline, form, or structure of.

detect—to discover or ascertain the existence, presence, or fact of.

device—a machine, manufacture, and/or collection thereof.

electric circuit—a system of electrically-connected electrical devices, the system providing a path for electrical energy to flow, i.e., a current path.

electro-magnetically—via production and/or detection of the generation of a magnetic field.

electronic trip device—an apparatus adapted to automatically open an electrical circuit upon detection of a predetermined electrical phenomena, such as a ground fault or an arc fault.

elongated—drawn out, made spatially longer, and/or having more length than width.

end—an extremity of something that has length; a terminus.

engage—to contact, cause to contact, interact, and/or cause to interact.

expose—to make readily visible.

extension—an addition, portion, and/or element that increases the area, influence, operation, and/or contents of something.

ground fault—any undesirable current path from a current-carrying conductor to ground.

handle—a manually operable lever for setting and/or resetting a position and/or status of a circuit breaker.

hemispherical—of, relating to, being, and/or having the shape of a half of a symmetrical, approximately spherical object as divided by a plane of symmetry.

hide—to make not readily visible.

indicate—to serve as a sign and/or signal integral—formed or united into another entity.

intersecting—cutting across and/or through.

latch—verb: to releasably fasten or hold; noun: that which releasably fastens or holds.

line—a geometric figure formed by a point moving along a fixed direction and the reverse direction.

located—situated in a particular spot and/or position.

location—a place.

longitudinal—located and/or running lengthwise.

magnetic element—a component adapted to be located in and/or adjacent the conducting path of the circuit breaker, and adapted to, in response to a current of a predetermined approximate amplitude for a predetermined approximate time, generate a magnetic field sufficient to substantially move an armature, armature latch, and/or a contact arm, thereby causing the circuit breaker to trip.

major—relatively great in size or extent.

may—is allowed to, in at least some embodiments.

mechanism—a device and/or portion thereof.

method—a process, procedure, and/or collection of related activities for accomplishing something.

molded case—an enclosure created by forming a molten thermoplastic.

move—to change in position from one point to another.

movement—an act or instance of moving.

non-electrically rendered—made perceptible via means that do not require electricity to continually operate, such as a flag, needle, dial, pointer, handle, etc.

In contrast, something can be electrically rendered via means that does require electricity to continually operate, such as a light, LED, LCD, siren, etc.

occurrence—an instance, act, and/or happening.

OFF position—with regard to a circuit breaker, a location and/or configuration associated with an open circuit.

ON position—with regard to a circuit breaker, a location and/or configuration associated with a closed circuit.

operating mechanism—a portion of a circuit breaker that comprises pivoting member moveable between an ON position, an OFF position and a TRIPPED position to selectively engage and disengage operating contacts of the circuit breaker.

parallel—being an equal distance apart everywhere.

planar—flat.

plunger—a core of a solenoid and/or a part, such as a piston, that operates with a thrusting and/or plunging movement.

plurality—the state of being plural and/or more than one.

position—to place, orient, and/or arrange.

predetermined—established in advance.

project—to thrust outward or forward.

radially—radiating from or converging to a common center and/or having or characterized by parts so arranged or so radiating.

release—to free from something that binds, fastens, or holds back.

reset—to move from a TRIPPED position and/or status to an ON position and/or status.

rotate—to turn around an axis and/or center.

rounded—being such that every part of the surface or the circumference is equidistant from the center.

separate—to set and/or keep apart.

set—a related plurality.

solenoid—an assembly used as a switch, and comprising a coil and a metal core free to slide along the coil axis under the influence of the magnetic field.

substantially—to a great extent or degree.

surface—the exterior and/or outer boundary of an object.

surrounding—to encircle, enclose or confine on all sides, and/or extend on all sides of simultaneously.

symmetric—having similarity in size, shape, and relative position of corresponding parts.

system—a collection of mechanisms, devices, data, and/or instructions, the collection designed to perform one or more specific functions.

thermally—via production and/or detection of the production of heat.

thermo-magnetic trip device—an apparatus adapted to automatically open an electrical circuit upon detection of a predetermined electrical phenomena occurring in conjunction with a flow of heat, such as a current overload or a voltage spike.

tip—a piece or an attachment, such as a cap or ferrule, meant to be fitted to the end of something else.

trip—to stop a flow of electric energy in an electric circuit by via opening a switch.

trip flag—an indicator that utilizes a color and/or pattern to indicate a TRIPPED electrical circuit.

trip indicator—an apparatus adapted to show a trip status (e.g., tripped, not tripped) of a circuit breaker or trip device.

TRIPPED position—with regard to a circuit breaker, a location and/or configuration associated with a tripped circuit.

unlatch—to release.

visual—able to be seen by the eye; visible.

voltage spike—a voltage above a predetermined value.

width—a measure in a direction perpendicular to a length and a thickness.

within—inside the limits of.

zone—an area and/or region.

DETAILED DESCRIPTION

This application incorporates by reference in their entirety the following U.S. patent documents: Publication 20050105234, and Ser. No. [11/070,073 (2004P03690US01 (1009-103)].

Certain exemplary embodiments comprise an electrical circuit breaker that comprises: an integral thermo-magnetic trip device adapted to trip said circuit breaker upon an occurrence of a current overload; an integral electronic trip device adapted to trip said circuit breaker upon detection of a ground fault and adapted to trip said circuit breaker upon detection of an arc fault.

Certain exemplary embodiments comprises a circuit breaker armature that comprises a contact zone intersected by a longitudinal axis of a solenoid comprising a plunger, the solenoid adapted to extend the plunger along the longitudinal axis to engage with the contact zone and move the armature, a predefined movement of the armature adapted to cause a trip of the circuit breaker.

The circuit breaker can be installed in an apparatus such as a typical circuit breaker panel for an alternating current electrical circuit. The circuit breaker can comprise a single or multiple handle. In the multiple handle arrangement, the handles can be bridged.

Figure 2:
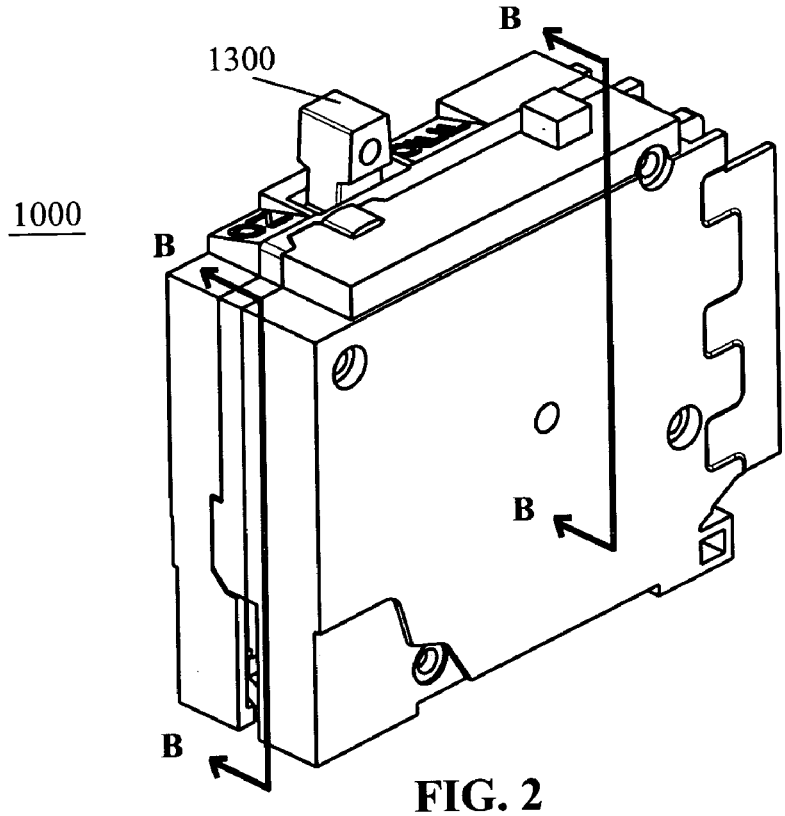
FIG. 2 is a perspective view of an exemplary embodiment of a circuit breaker 1000 in a TRIPPED position.

FIG. 1 is a perspective view of an exemplary embodiment of a circuit breaker 1000 in an ON position, and FIG. 2 is a perspective view of an exemplary embodiment of circuit breaker 1000 in a TRIPPED position.

Circuit breaker 1000 can comprise a body 1100 that can substantially contain and or surround most of the components of circuit breaker 1000. Body 1100 can comprise a thermo-magnetic portion 1120 that can comprise a well known thermo-magnetic trip device 1200. Body 1100 can comprise an electronic portion 1140 that can comprise a well known electronic trip device 1400.

Via its position with respect to body 1100, a handle 1300 can visually indicate a status of circuit breaker 1000, such as ON, TRIPPED, and/or OFF, etc. Handle 1300 can be moved into the TRIPPED position automatically by operation of various components of circuit breaker 1000. Thus, by nature of its position, handle 1300 can indicate a TRIPPED status without the application of electricity thereto, and thus handle 1300 can serve as a non-electrically rendered trip indicator. Handle 1300 can be moved into the ON, TRIPPED, and OFF positions manually. As shown, handle 1300 is in the ON position in FIG. 1, and in the TRIPPED position in FIG. 2.

Circuit breaker 1000 and/or electronic trip device 1400 can comprise an electronic trip indicator window 1440, through which a trip flag (shown in FIG. 3) can be revealed upon occurrence of an particular type of trip, such as either a thermoelectric trip or an electronic trip. Circuit breaker 1000 and/or electronic trip device 1400 can comprise a ground fault reset test button 1420, the manual actuation of which can trip circuit breaker 1000, electronic trip device 1400, and/or handle 1200 from an ON position to a TRIPPED position, thereby potentially revealing an electronic trip flag.

To reset circuit breaker 1000, thermo-magnetic trip device 1200, and/or electronic trip device 1400, handle 1300 can be moved from the TRIPPED position to the OFF position, and then to the ON position.

Figure 3:
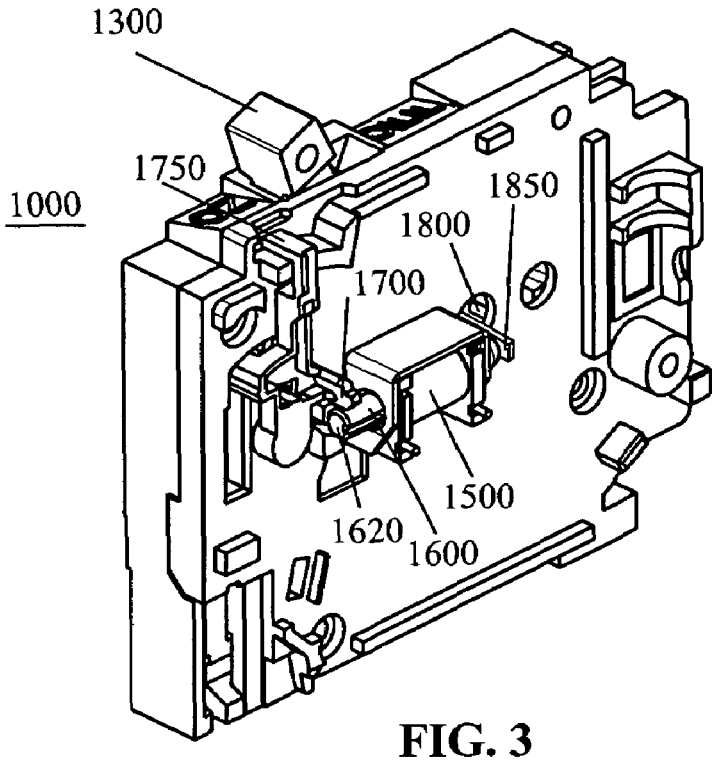
FIG. 3 is a cross-sectional view taken at section line A-A of FIG. 1.
Figure 4:
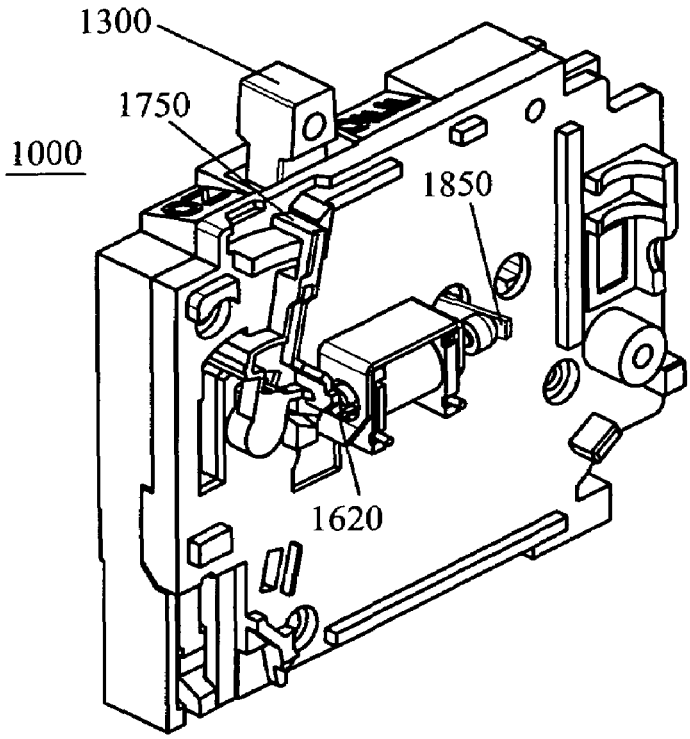
FIG. 4 is a cross-sectional view taken at section line B-B of FIG. 2.
Figure 5:
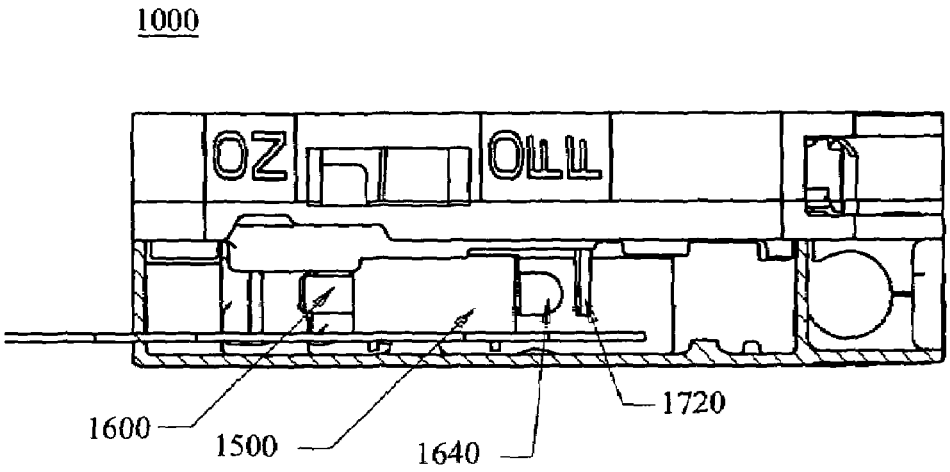
FIG. 5 is a top view of the embodiment shown in FIG. 3.
Figure 6:
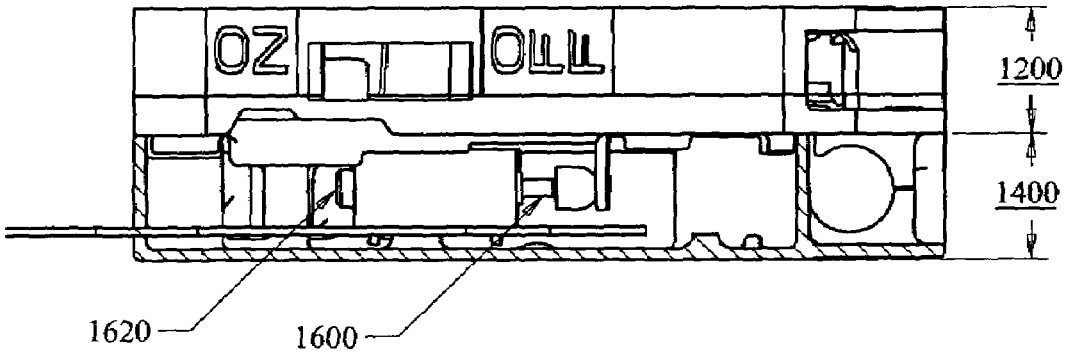
FIG. 6 is a top view of the embodiment shown in FIG. 4.

FIG. 3 is a cross-sectional view taken at section line A-A of FIG. 1, and FIG. 4 is a cross-sectional view taken at section line B-B of FIG. 2. FIG. 5 is a top view of the embodiment shown in FIG. 3, and FIG. 6 is a top view of the embodiment shown in FIG. 4.

Circuit breaker 1000 and/or electronic trip device 1400 can comprise a solenoid 1500 that can be actuated upon detection of a predetermined condition, such as a ground fault and/or an arc fault.

A first end 1620 of a substantially cylindrical plunger 1600 that is integral, co-axial with, comprised by, and/or attached to solenoid 1500 can be positioned to contact a trip flag arm 1700, to which a trip flag 1750 can be integral. A second end 1640 of plunger 1600 can contact a biased thermo-magnetic trip arm or armature 1850, which can extend through a passage 1800 and be coupled to thermo-magnetic trip device 1200.

Prior to actuation of electronic trip device 1400 and/or solenoid 1500, when circuit breaker 1000, electronic trip device 1400, and/or handle 1200 are in the ON position, a first end of plunger 1600 that is integral and/or attached to solenoid 1500 can be positioned to raise a trip flag arm 1700, thereby causing an attached trip flag 1750 to appear in a non-tripped position, such that trip flag 1750 is not substantially visible through and/or via trip window 1440 (shown in FIG. 1).

Upon actuation of solenoid 1500, plunger 1600 can be positioned to release and/or lower trip flag arm 1700, thereby causing attached trip flag 1750 to appear in a tripped position and thereby be visible via the trip window, thereby visibly indicating that electronic trip device 1400 has tripped. To further enhance its visibility, trip flag 1750 can be colored and/or patterned. For example, trip flag 1750 can be colored bright yellow, or provided in a yellow and black stripped pattern, which can noticably contrast with a background (such as a black background) that is visible via the trip window when trip flag 1750 is hidden or in a non-tripped position.

Also, plunger 1600 can move biased armature 1850, thereby tripping thermo-magnetic trip device 1200, and thereby causing circuit breaker 1000 and/or handle 1200 to move from the ON position to the TRIPPED position.

Upon actuation of electronic trip device 1400 alone, circuit breaker 1000 and/or handle 1200 can move from the ON position to the TRIPPED position, and trip flag 1750 can be visible in the trip window. Thus, handle 1300 can indicate the occurrence of some type of trip, and trip flag 1750 can indicate the occurrence of an electronic trip, leading one to deduce that the trip involved electronic trip device 1400, and thus was likely and/or definitely caused by a ground fault and/or arc fault.

Upon actuation of thermo-magnetic trip device 1200 alone, circuit breaker 1000 and/or handle 1200 can move from the ON position to the TRIPPED position, yet no trip signal need be sent to solenoid 1500, and thus no movement of trip flag 1750 need occur. Thus, trip flag 1750 can indicate the non-occurrence of an electronic trip, yet handle 1300 can indicate the occurrence of some type of trip, leading one to deduce that the trip involved thermo-magnetic trip device 1200, and thus was likely and/or definitely caused by a current overload and/or voltage spike.

Upon resetting circuit breaker 1000 and/or handle 1300 by moving handle 1300 from the TRIPPED position to the OFF position (possibly followed by moving handle 1300 to the ON position), thermo-magnetic trip device 1200 and/or electronic trip device 1400 can be reset, and thereby trip flag 1750 can be returned to the untripped position.

Thus, the electronic trip indicator can indicate if the trip was generated by the electronic trip function of the circuit breaker, thereby helping to isolate the cause of the trip and/or facilitating trouble-shooting of the circuit.

Figure 7:
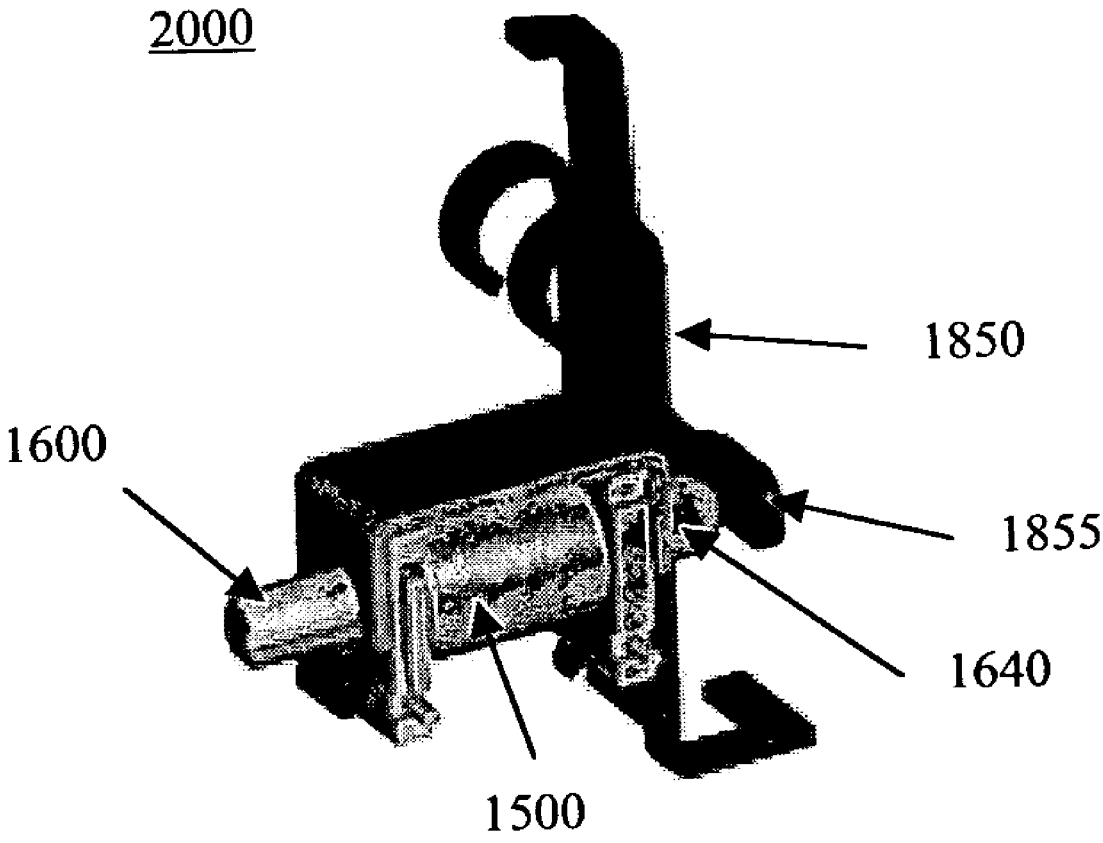
FIG. 7 is a perspective view of an exemplary embodiment of a subsystem 2000.

FIG. 7 is a perspective view of an exemplary embodiment of a subsystem 2000, which can provide a means of engagement between the solenoid 1500 and biased armature 1850 that can solve an assembly and/or scrap problem. Subsystem 2000 can include an armature extension 1855 coupled and/or integral to armature 1850, and a plunger tip 1640 located at one end of plunger 1600 and adapted to engage with and/or move armature extension 1855. Plunger tip 1660 can be substantially hemispherical, paraboloidal, rounded, and/or radially symmetrical about the longitudinal axis of plunger 1600, and/or can have a substantially curvilinear cross-section when sectioned along the longitudinal axis of plunger 1600. Extension 1855 can be aligned with the longitudinal axis of plunger 1600 so that no matter to what position plunger 1600 rotates about its longitudinal axis, plunger tip will always properly contact and move armature extension 1855, and thereby armature 1850. Consequently, related misalignments and/or failures, such as might otherwise arise from assembly of subsystem 2000 and/or system 1000 (shown in FIGS. 1-6), can be substantially reduced and/or eliminated.

Figure 8:
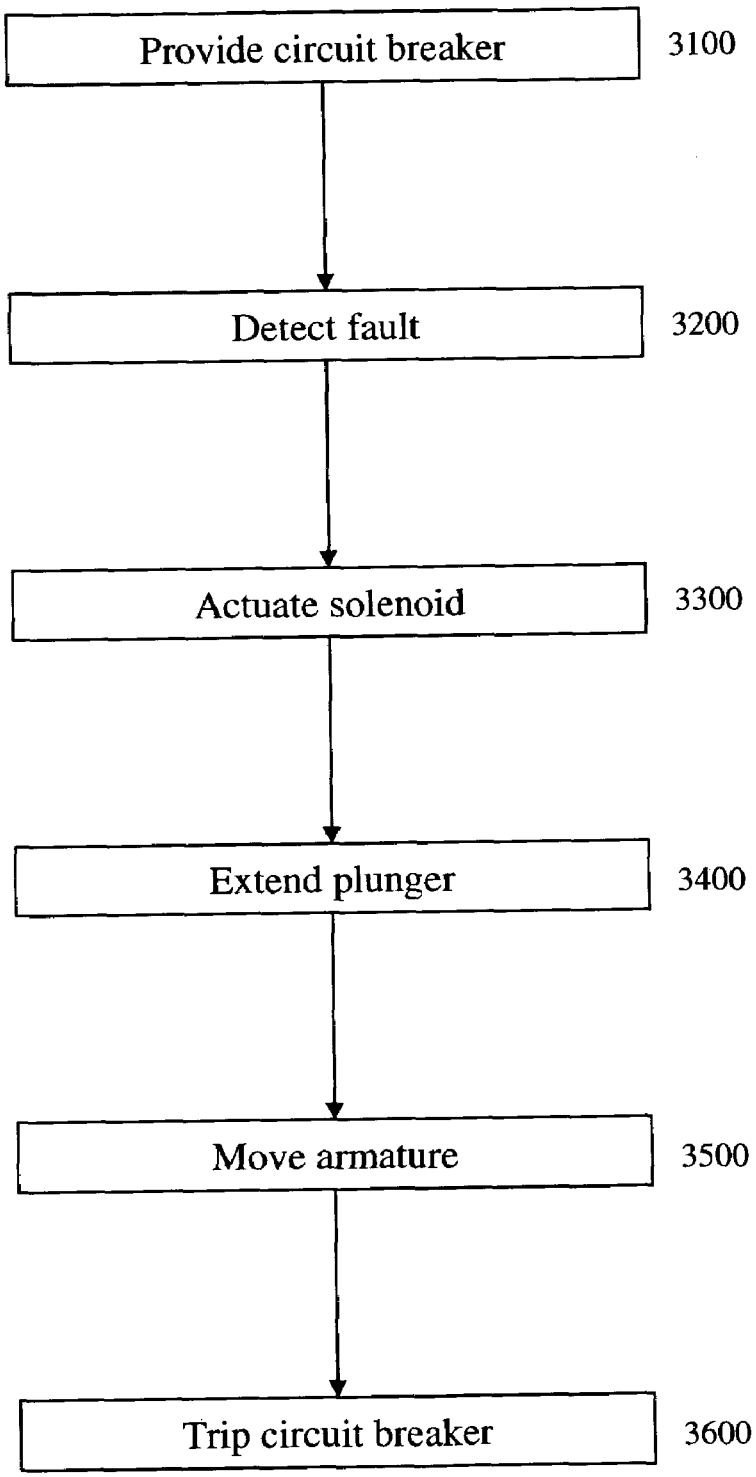
FIG. 8 is a flowchart of an exemplary embodiment of a method 3000.

FIG. 8 is a flowchart of an exemplary embodiment of a method 3000. At activity 3100, a circuit breaker can be provided that comprises an integral thermo-magnetic trip device that is adapted to trip the circuit breaker upon an occurrence of a current overload. The circuit breaker can comprise an integral electronic trip device that is adapted to trip the circuit breaker upon detection of a ground fault and adapted to trip the circuit breaker upon detection of an arc fault. The integral electronic trip device can comprise a solenoid adapted to actuate upon at least one of the ground fault and the arc fault. The solenoid can comprise a plunger that comprises a substantially paraboloidal plunger tip located at an end of the plunger and is defined about a longitudinal axis of said solenoid. The plunger tip can be adapted to contact and move a biased armature.

At activity 3200, a ground fault or an arc fault can be detected. At activity 3300, upon detection of a ground fault or an arc fault, the solenoid can be actuated. At activity 3400, actuation of the solenoid can cause the plunger to extend. At activity 3500, extension of the plunger can cause the plunger tip to contact and move the biased armature. At activity 3600, a predetermined movement of the biased armature can cause the circuit breaker to trip.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, such as via an explicit definition, there is no requirement for the inclusion in any claim herein (or of any claim of any application claiming priority hereto) of any particular described or illustrated characteristic, function, activity, or element, any particular sequence of activities, or any particular interrelationship of elements. Moreover, any activity can be repeated, any activity can be performed by multiple entities, and/or any element can be duplicated. Further, any activity or element can be excluded, the sequence of activities can vary, and/or the interrelationship of elements can vary. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

What is claimed is:

1. An apparatus, comprising: a circuit breaker comprising: an integral thermo-magnetic trip device adapted to trip said circuit breaker upon an occurrence of a current overload and adapted to trip said circuit breaker upon an occurrence of a voltage spike of at least a predetermined level; an integral electronic trip device adapted to trip said circuit breaker upon detection of a ground fault and adapted to trip said circuit breaker upon detection of an arc fault; and an armature adapted to cause a trip of said circuit breaker upon a predetermined movement of said armature, said armature comprising a contact zone adapted to be moved by a substantially cylindrical plunger that defines a longitudinal axis of a solenoid, said solenoid adapted to project said plunger along said longitudinal axis, said longitudinal axis intersecting said contact zone.

2. The apparatus of claim 1, wherein said contact zone is located on an armature extension connected to and comprised by said armature.

3. The apparatus of claim 1, wherein said contact zone is located on an armature extension integral to said armature.

4. The apparatus of claim 1, further comprising a plunger tip located at an axial end of said plunger.

5. The apparatus of claim 1, further comprising a plunger tip surrounding an axial end of said plunger.

6. The apparatus of claim 1, further comprising a substantially rounded plunger tip located at an axial end of said plunger.

7. The apparatus of claim 1, further comprising a substantially hemispherical plunger tip located at an axial end of said plunger.

8. The apparatus of claim 1, further comprising a plunger tip located at an axial end of said plunger, said plunger tip substantially radially symmetrical about said longitudinal axis.

9. The apparatus of claim 1, further comprising a plunger tip located at an axial end of said plunger, said plunger tip adapted to rotate about said longitudinal axis.

10. The apparatus of claim 1, further comprising a non-electrically rendered trip indicator adapted to visually indicate an occurrence of a trip at of least one of said integral thermo-magnetic trip device and said integral electronic trip device.

11. The apparatus of claim 1, further comprising a non-electrically rendered electronic trip indicator adapted to visually indicate an occurrence of a trip of only said electronic trip device.

12. The apparatus of claim 1, wherein said solenoid is adapted to actuate upon detection of said ground fault.

13. The apparatus of claim 1, wherein said solenoid is adapted to actuate upon detection of said arc fault.

14. The apparatus of claim 1, wherein said armature is adapted to release said circuit breaker from an ON position to a TRIPPED position.

15. The apparatus of claim 1, wherein said armature is adapted to release said circuit breaker from an ON position to a TRIPPED position upon detection of said ground fault.

16. The apparatus of claim 1, wherein said armature is adapted to release said circuit breaker from an ON position to a TRIPPED position upon detection of said arc fault.

17. The apparatus of claim 1, wherein said solenoid is adapted to expose a trip flag upon detection of at least one of said ground fault and said arc fault.

18. The apparatus of claim 1, wherein said solenoid is adapted to expose a trip flag in an electronic trip indicator window upon detection of at least one of said ground fault and said arc fault.

19. An apparatus, comprising: a circuit breaker comprising: an integral electronic trip device adapted to trip said circuit breaker upon detection of a ground fault and adapted to trip said circuit breaker upon detection of an arc fault; and an armature adapted to cause a trip of said circuit breaker upon a predetermined movement of said armature, said armature comprising a contact zone adapted to be moved by a substantially cylindrical plunger that defines a longitudinal axis of a solenoid, said solenoid adapted to project said plunger along said longitudinal axis, said longitudinal axis intersecting said contact zone.

20. A method for tripping a circuit breaker, comprising:

providing a circuit breaker that comprises: an integral thermo-magnetic trip device adapted to trip said circuit breaker upon an occurrence of a current overload; an integral electronic trip device adapted to trip said circuit breaker upon detection of a ground fault and adapted to trip said circuit breaker upon detection of an arc fault; and an armature comprising a contact zone intersected by a longitudinal axis of a solenoid comprising a substantially cylindrical plunger;

upon detection of said ground fault or said arc fault, contacting said plunger against said contact zone; and tripping the circuit breaker.

* * * * *